United States Patent [19]

Morane

[11] 4,062,477

[45] Dec. 13, 1977

[54] CONTAINER HAVING FLEXIBLE WALLS AND TWO CHAMBERS WHICH ARE KEPT SEPARATE UNTIL THE CONTAINER IS OPENED

[75] Inventor: Bruno Morane, Paris, France

[73] Assignee: L'Oreal, Paris, France

[21] Appl. No.: 420,710

[22] Filed: Nov. 30, 1973

[30] Foreign Application Priority Data

Dec. 22, 1972 France ..... 72.45951

[51] Int. Cl.[2] ..... B65D 83/00

[52] U.S. Cl. ..... 222/145; 222/213

[58] Field of Search ..... 222/129, 136, 145, 213, 222/212, 94; 128/218 M

[56] References Cited

U.S. PATENT DOCUMENTS

| | | | |
|---|---|---|---|
| 2,159,217 | 5/1939 | Lozier et al. | 128/218 M |
| 2,869,543 | 1/1959 | Ratcliff et al. | 128/218 M |
| 3,207,374 | 9/1965 | Holmes et al. | 222/213 X |
| 3,326,215 | 6/1967 | Sarnoff et al. | 128/218 M |
| 3,330,280 | 7/1967 | Ogle | 128/218 M |
| 3,351,058 | 11/1967 | Webb | 222/94 X |
| 3,458,076 | 7/1969 | Babcock | 222/129 X |

*Primary Examiner*—Robert B. Reeves
*Assistant Examiner*—Joseph J. Rolla
*Attorney, Agent, or Firm*—Brisebois & Kruger

[57] ABSTRACT

Tube having flexible walls and a neck separated from the remainder of the tube by a transverse wall having an opening therein closed by a plug adapted to be expelled from the orifice when the tube is squeezed. The plug is cup-shaped and made of a rubbery material so as to increase the permissible manufacturing tolerances.

9 Claims, 1 Drawing Figure

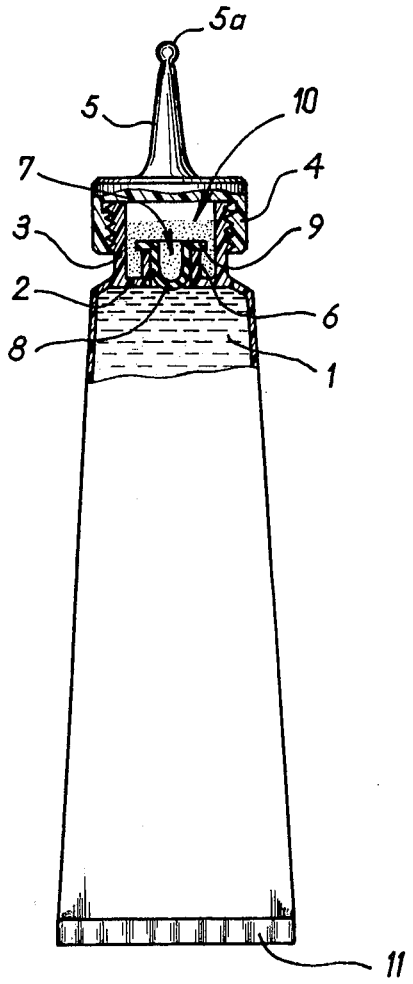
5a
5
10
7
4
3
9
2
6
8
1
11

CONTAINER HAVING FLEXIBLE WALLS AND TWO CHAMBERS WHICH ARE KEPT SEPARATE UNTIL THE CONTAINER IS OPENED

It is often necessary to store separately two products which must be mixed just before use, and several devices for this purpose have already been proposed.

The present invention relates to a device of the general type decribed in French Pat. No. 1,044,686. This comprises a flexible tube holding a first substance, such as a liquid, for example, the neck of the tube being externally threaded to cooperate with a dispensing cap and a separating wall being positioned at the bottom of the neck. This wall is pierced by a central orifice which receives a plug. The space inside the neck between the separating wall and the dispensing cap holds a second substance, such as a powder, for example.

The plug in the orifice of the separating wall separates the two compartments of the device during storage. At the moment of use, pressure is exerted on the flexible tube so as to create an increased pressure inside the tube and expel the separating plug into the neck. This permits the mixture of the two substances held in the two compartments.

The problems posed when manufacturing this known device relate essentially to the manufacture of the plug seated in the separating wall. In effect, it is necessary to be able to manufacture the plug in a large number of different sizes and that the manufacturing tolerances be such that the device may be reasonably inexpensive. It is, however, necessary in all cases, despite the manufacturing tolerance with respect to the external diameter of the plug and the internal diameter of the orifice in the separating wall which must be accepted for economic reasons, that an effective seal be maintained between the two compartments if the products stored therein are not to deteriorate during storage. There is therefore a tendancy to increase the tightness of the fit between the plug and the orifice in the separating wall. However, if this is increased, it has been found that, in a substantial number of cases, it is no longer possible to make the device operate satisfactorily because when the fingers of the user press on the flexible tube, they are not capable of creating in this tube a pressure which is sufficiently great to insure that the plug is expelled. Devices of the above type have accordingly proved in practice to be either unreliable or relatively expensive.

It is the object of the present invention to define the characteristics of a specific plug which, despite the relatively large manufacturing tolerance necessary if the device is to be relatively inexpensive, makes it possible to obtain both an effective seal and reliable operation of the package in response to the pressure exerted by the fingers of a user.

In accordance with the invention it has been found that it is necessary, in order to insure satisfactory operation of the device in question, to use plugs which are not made of an inelastic plastic material but are made of a rubbery plastic material. It has also been found that if the elastic plug is gripped with sufficient firmness inside the opening in the separating wall, an adequate, reliable seal may be provided while retaining the possibility of ejecting the plug whenever the pressure inside the tube is increased, if the hollow plug is used. According to the invention, a cup-shaped plug has accordingly been adopted, with the bottom of the plug directed toward the compartment to which the ejecting pressure is applied.

It was then found that the rubbery materials used had a tendancy to swell in the course of time due to the effect of the liquid contained in the tube, or to become stuck during storage of the tube. According to the invention it has therefore been proposed to coat the wall of the plug of rubbery material with a lubricant, such as a silicone oil, for example. While this produced a much greater facility of ejection of the plug, it was as a consequence necessary to increase the friction between the wall of the plug and the wall of the orifice in which it is inserted, and in order to do this, in accordance with the invention, the firmness of the grip between the plug and orifice wall has been increased and the orifice has been provided with a neck on that side of the separating wall which is not subject to the ejecting pressure.

It is accordingly the object of the present invention to provide as a new article of manufacture a container having a flexible outer wall and provided with a transverse separating wall in its neck. This separating wall is provided with a central orifice in which a plug is inserted. The neck is provided with external means for attaching thereto a cap which closes the space within the neck defined between said separating wall and cap. This device is characterized by the fact that the orifice in the separating wall is itself encircled by a cylindrical collar preferably projecting toward the inside of the container neck, and that the plug inserted in said collar is cup-shaped, with the bottom of the cup directed toward the side of the separating wall facing the flexible tube. The plug is made of a rubbery material and has an external shape mating with the collar, each radial dimension of the plug in its free state having a length 1.01 – 1.07 times that of the corresponding radial dimension of the inner wall of the collar. The plug is covered, at least externally, by a fine layer of lubricant.

In a preferred embodiment of the invention, the plug and the collar have cylindrical external walls. If the outer radius of the plug is designated by "$r$", the height of the collar and the plug are between $0.5r$ and $2.5r$; and the thickness of the wall of the plug (which is made of butyl rubber) is substantially constant and between $0.2r$ and $0.6r$. The end of the plug which is remote from the bottom of the cup is provided with a flange which bears on the corresponding end of the collar. The manufacturing tolerance with respect to the external radius of the plug lies between $\pm 0.01r$ and $0.02r$. The manufacturing tolerance with respect to the internal radius of the collar is at most equal to $0.01r$. The external radius "$r$" of the plug in its free state is between 1.03 and 1.05 the length of the internal radius of the wall of the collar. The surface of the plug is lubricated with a silicone oil. The plug is lubricated by vaporization in a drum. The container is manufactured by injection molding the neck part onto a preformed tube of plastic material. The separating wall with its central orifice is formed during the injection and the collar encircling the orifice is formed in a subsequent operation and attached by any suitable means, as for example ultrasonic welding.

It should be noted that the fact that the collar is connected to the separating wall instead of being produced during the injection step makes it possible to obtain much closer tolerances for said collars at relatively little expense. It has been found that in the container according to the invention, the force necessary to eject the plug from the collar may be obtained by applying on or within the flexible tube an increase of from 0.35 – 0.5 bars of pressure. It is clear that this increase in pressure may be easily applied by the fingers of a user, so that the container is reliable in all cases. The adoption of the device according to the invention thus makes it possible, while observing manufacturing tolerances permitting relatively inexpensive manufacture, to obtain a container which is reliable in operation.

In order that the object of the invention may be better understood, a preferred embodiment thereof will now be described, purely by way of illustration and example, with reference to the accompanying drawing in which:

The single FIGURE is a longitudinal cross-sectional view taken through a container according to the invention.

Referring now to the drawing, it will be seen that reference numeral 1 indicates a flexible polyethylene tube. The neck of the tube has been injection molded onto the prefabricated tube 1, with said tube mounted on a mandrel. This method of injection molding has made it possible to obtain, on the one hand, a transverse separating wall and, on the other hand, an externally threaded neck 3. A dispensing cap 4 is mounted on the neck 3 so that it may be screwed down on the neck 3 and comprises a conical dispensing tube 5 closed at its upper end 5*a* during storage. The transverse separating wall has a central circular orifice inside which, after the super injection, a collar of molded plastic material 6 is attached by ultrasonic-welding. This collar has an internal diameter between 8.91mm and 9.09mm. The fact that the member constituting the collar 6 is separately molded makes it possible to obtain closer tolerances for this member without substantially increasing its cost. Inside the collar is a plug 7. The plug 7 is in the form of a cup, the bottom 8 of which is positioned adjacent to tube 1, while its edge 9 is in the form of a flange which rests on the upper part of the collar 6. The plug 7 is made of a butyl rubber having a Shore hardness of 50/70. Its wall has an average thickness of 2.5mm. Its external diameter in the zone of the cup defined between the bottom 8 and the flange 9 lies, when the cup is uncompressed, between 9.38 and 9.42mm. After its manufacture, the plug 7 is vapor-treated inside a drum with a silicone oil. The total height of the plug is 6mm.

The container which has just been described is filled in the following manner. The plug 7 is inserted in the collar 6 and the space 10 therewithin is filled with a powder which is to be mixed with the liquid in the tube 1. The tube itself is then filled through its other end 11, which is still open, and this end is then welded, soldered, or crimped shut. Alternatively, it is also possible to fill the tube first through the collar 6, after its end 11 has already been closed. The plug 7 is then inserted in the collar 6 and a powder intended to be mixed with the liquid in the tube 1 is then introduced into the space defined within the neck 3 just before use.

In both of the above described filling methods the plug 7 is so gripped in the collar 6 as to insure perfect sealing between the two chambers. The cap 4 is then screwed on the neck 3 and the container is ready for storage.

At the moment of use, the user exerts a pressure on the flexible tube 1 which is communicated to the bottom 8 of the plug by reason of the presence of liquid in the tube 1. In response to this pressure, the plug is ejected from the collar 6, which permits the liquid to mix with the powder contained in the neck 3. In the embodiment which has just been described, the pressure required to eject the plug 7 from the collar 6 is always between 0.35 bars and 0.55 bars. It follows that the plug may always be ejected by the action of the fingers of the user, despite the relatively large tolerances which have been permitted in manufacturing the plug and the collar.

It will of course be appreciated that the embodiment which has just been described has been given purely by way of example, and may be modified as to detail without thereby departing from the basic principles of the invention.

What is claimed is:

1. Container having flexible walls and a relatively narrow neck separated from the remainder of said container by a transverse wall provided with a central orifice, a plug in said orifice, and external means on said neck for attaching thereto a cap which closes the space within the neck above said separating wall, wherein the improvement comprises a collar along the edge of said orifice, said plug being frictionally retained in said collar and having the form of a cup, the bottom of which cup is directed toward the portion of the container having flexible walls, said plug forming with said wall and collar the sole fluid-tight barrier preventing the passage of liquid from the remainder of said container into said neck, said plug being made of a rubbery material and having an external shape mating with that of the collar, each radial dimension of the plug, when uncompressed, having a length between 1.01 and 1.07 times that of the corresponding radial dimension of the inner wall of the collar, said plug being coated on at least its external surface by a fine layer of lubricant permitting its expulsion from said collar when pressure is exerted on said flexible walls.

2. Container as claimed in claim 1 in which the plug is made of butyl rubber.

3. Container as claimed in claim 1 in which the end of the plug remote from the bottom thereof is provided with a flange resting on the corresponding end of the collar.

4. Container as claimed in claim 1 in which the surface of the plug is coated with a silicone oil.

5. Container as claimed in claim 1 in which the plug and collar have cylindrical external walls.

6. Container as claimed in claim 5 in which the heights of the collar and the plug lie between 0.5 and 2.5 times the external radius of the plug.

7. Container as claimed in claim 5 in which the thickness of the wall of the plug is substantially constant and lies between 0.2 and 0.6 times the external radius of the plug.

8. Container as claimed in claim 5 in which the manufacturing tolerance with respect to the external radius of the plug lies between $\pm$ 0.01 and $\pm$ 0.02 and the manufacturing tolerance with respect to the internal radius of the collar is at most equal to 0.01 times the external radius of the plug.

9. Container as claimed in claim 5 in which the length of the external radius of the plug when uncompressed lies between 1.03 and 1.05 times the length of the internal radius of the wall of the collar.

* * * * *